US005794824A

United States Patent [19]

Jeong

[11] Patent Number: 5,794,824

[45] Date of Patent: Aug. 18, 1998

[54] VESSEL FOR CONTAINING LIQUID

[76] Inventor: Chang-rock Jeong, 210-41, 4-dong, Seongsu 2-ga, Seongdong-gu, Seoul, 133-120, Rep. of Korea

[21] Appl. No.: 773,861

[22] Filed: Dec. 27, 1996

Related U.S. Application Data

[63] Continuation of Ser. No. 411,737, filed as PCT/KR93/00089 Oct. 6, 1993, published as WO94/07756 Apr. 14, 1994, abandoned.

[30] Foreign Application Priority Data

| | | | |
|---|---|---|---|
| Oct. 7, 1992 | [KR] | Rep. of Korea | 1992-19237 |
| Jun. 21, 1993 | [KR] | Rep. of Korea | 1993-10983 |
| Jun. 23, 1993 | [KR] | Rep. of Korea | 1993-11187 |

[51] Int. Cl.[6] ..... B67D 3/00

[52] U.S. Cl. ..... 222/468; 222/485.1; 222/488

[58] Field of Search ..... 222/468, 481, 222/481.5, 482, 483, 484, 488

[56] References Cited

U.S. PATENT DOCUMENTS

| | | | |
|---|---|---|---|
| 932,026 | 8/1909 | Keller | 222/468 |
| 3,746,200 | 7/1973 | Flider | 222/482 X |
| 4,034,901 | 7/1977 | Kirk | 222/481.5 |
| 4,241,855 | 12/1980 | Yoshioka | 222/481.5 X |
| 4,412,633 | 11/1983 | Guerrazzi et al. | 222/468 |
| 4,585,150 | 4/1986 | Beacham et al. | 222/481.5 X |
| 5,002,209 | 3/1991 | Goodall | 222/481.5 X |
| 5,340,000 | 8/1994 | Ring | 222/468 |

FOREIGN PATENT DOCUMENTS

| | | | |
|---|---|---|---|
| 6100003 | 4/1994 | Japan | 222/481.5 |
| 2220408 | 1/1990 | United Kingdom | 222/481.5 |

*Primary Examiner*—Joseph Kaufman
*Attorney, Agent, or Firm*—Dvorak & Orum

[57] ABSTRACT

A vessel for containing liquid comprises a container (41) for containing liquid (40), a gripping portion (42) which is separated from one side of the container and extended upward, having an air intake portion (43) on the top of the gripping portion, wherein air flowing via the air intake portion passes through the gripping portion and communicates with the container, and a neck portion (44) which is separated from the other side of the container and extended upward, having a liquid discharge portion (45) at the top of the neck portion for discharging liquid from the container, wherein the neck portion extends through the bottom of the air intake portion in the gripping portion and protrudes into the air intake portion. A cap (46) having a hinge structure is provided so as to be capable of simultaneously covering the air intake portion and the liquid discharge portion.

7 Claims, 11 Drawing Sheets

VESSEL FOR CONTAINING LIQUID

This application is a continuation of application Ser. No. 08/411,737, filed as PCT/KR93/00089 Oct. 6, 1993 published as WO94/07756 Apr. 14, 1994 now abandoned.

TECHNICAL FIELD

The present invention relates to a vessel for containing liquid such as water, oil or detergents in liquid form, and more particularly, to an improved liquid-containing vessel, such that the liquid can be smoothly discharged without generating internal low pressure and the resulting, loud gurgling sound.

BACKGROUND ART

As shown in FIG. 1, in a conventional vessel for liquid, a liquid discharging portion 12 is formed on the upper portion of a container 11 in which liquid is contained, and a gripping portion 13 is formed in one side of container 11. As shown in FIG. 2 as another example, a vessel for containing liquid has a structure in which a cover 24 can be separated from a container 21 having a handle grip 23, and has been widely used.

However, in such a conventional vessel for containing liquid and having the above structures as shown in FIGS. 1 and 2, when liquid 10 (or 20) in container 11 (or 21) is discharged from the vessel, external air must enter the container via liquid discharge portion 12 (or 22) to equalize the pressure difference created. Concurrent with this air intake, the liquid in container 11 (or 21) is being discharged from the vessel. Accordingly, when large amounts of liquid are poured from the vessel, the air intake into container 11 (or 21) is insufficient or becomes blocked altogether. Accordingly, a pressure difference is generated between the interior and exterior of the vessel. Due to this pressure difference, when the liquid is poured, an alternating action ensues, i.e., gushing of the liquid and air intake, such that the liquid flows sporadically and makes a loud gurgling sound.

To overcome the above problem, a vessel (31) for containing liquid has been developed as shown in FIG. 3. In FIG. 3, on its top portion, the vessel has an air intake portion 35 which is separated from a liquid discharge portion 32 having a spout cap 37. The vessel for containing liquid having such a structure has usually an intake cap 36 for preventing foreign matter from entering the vessel and to prevent spillage during the vessel's transport.

Such a vessel for containing liquid can prevent the liquid from making the loud gurgling sound when poured. However, since air intake portion 35 for air intake is separated from with liquid discharge portion 32, the user is inconvenienced in that intake cap 36 and spout cap 37 should both be opened whenever the liquid is to be discharged.

DISCLOSURE OF THE INVENTION

Therefore, to solve the above problems, it is an object of the present invention to provide an improved vessel for containing liquid in which an air intake portion and a liquid discharge portion are integrally formed, thereby enabling liquid to be smoothly discharged without generating internal low pressure and the resulting, loud gurgling sound when the liquid is discharged without separate air inlet means.

To accomplish the above object of the present invention, according to one aspect of the present invention, there is provided a vessel for containing liquid comprising:

a container for containing liquid;

a gripping portion which is separated from one side of the container and extended upward, having an air intake portion on the top of the gripping portion, wherein air flowing via the air intake portion passes through the gripping portion and communicates with the container; and a neck portion which is separated from the other side of the container and extended upward, having a liquid discharge portion for discharging liquid from the container on the top of the neck portion, wherein the neck portion passes through the bottom of the air intake portion formed in the upper portion of the gripping portion and protrudes into the air intake portion.

According to another aspect of the present invention, a vessel for containing liquid comprises:

a container for containing liquid, whose upper portion is open;

a cap which is designed to cover the open upper portion of the container, having an air intake portion to one side of the cap; and an intermediate member having an upper surface, a lower surface, and a hollow liquid discharge portion extending upward from the upper and lower surfaces, the intermediate member being formed with at least one groove on the upper surface, wherein the upper surface is fixed onto the lower surface of the cap so that the liquid discharge portion passes through the air intake portion and protrudes outside the container at the point where the air intake portion of the cap is located, and that at least one air intake passage is formed between the lower surface of the cap and the groove of the intermediate member for guiding air flowing via the air intake portion of the cap into the container.

BRIEF DESCRIPTION OF THE DRAWINGS

The above object and other advantages of the present invention will become more apparent by describing in detail a preferred embodiment of the present invention with reference to the attached drawings in which.

BEST MODE FOR CARRYING OUT THE PREFERRED EMBODIMENTS

Figure 4:
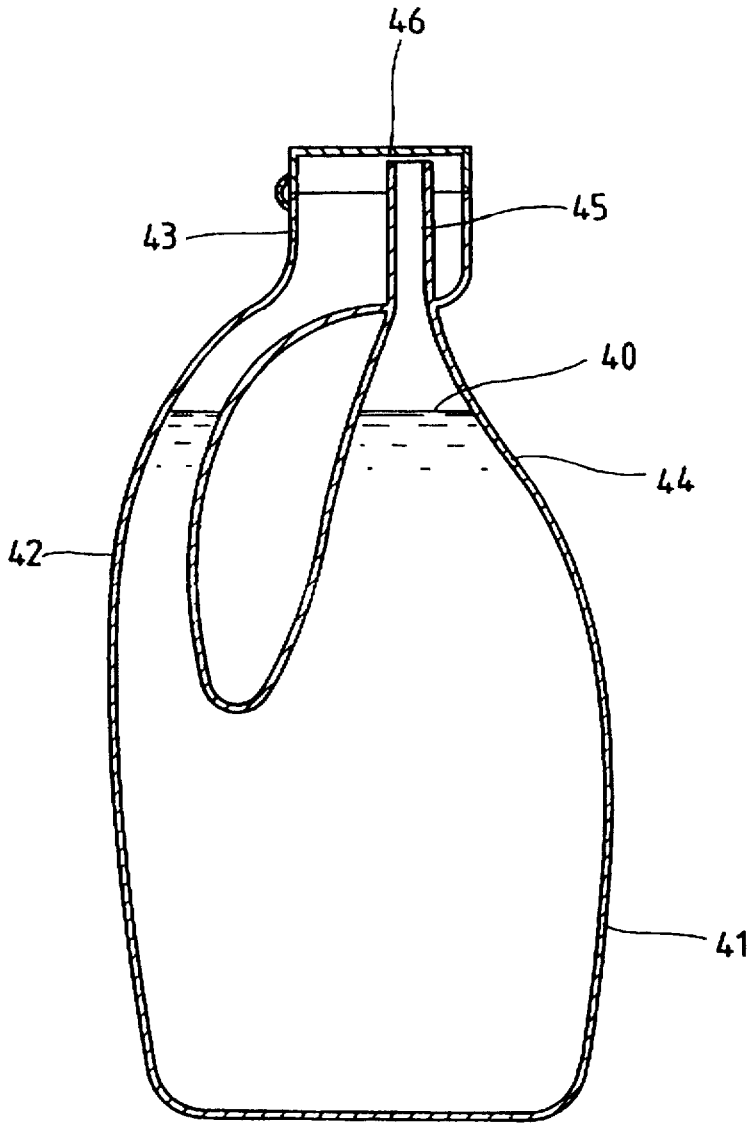
FIG. 4 is a cross-sectional view showing a vessel for containing liquid according to a first embodiment of the present invention.
Figure 5:
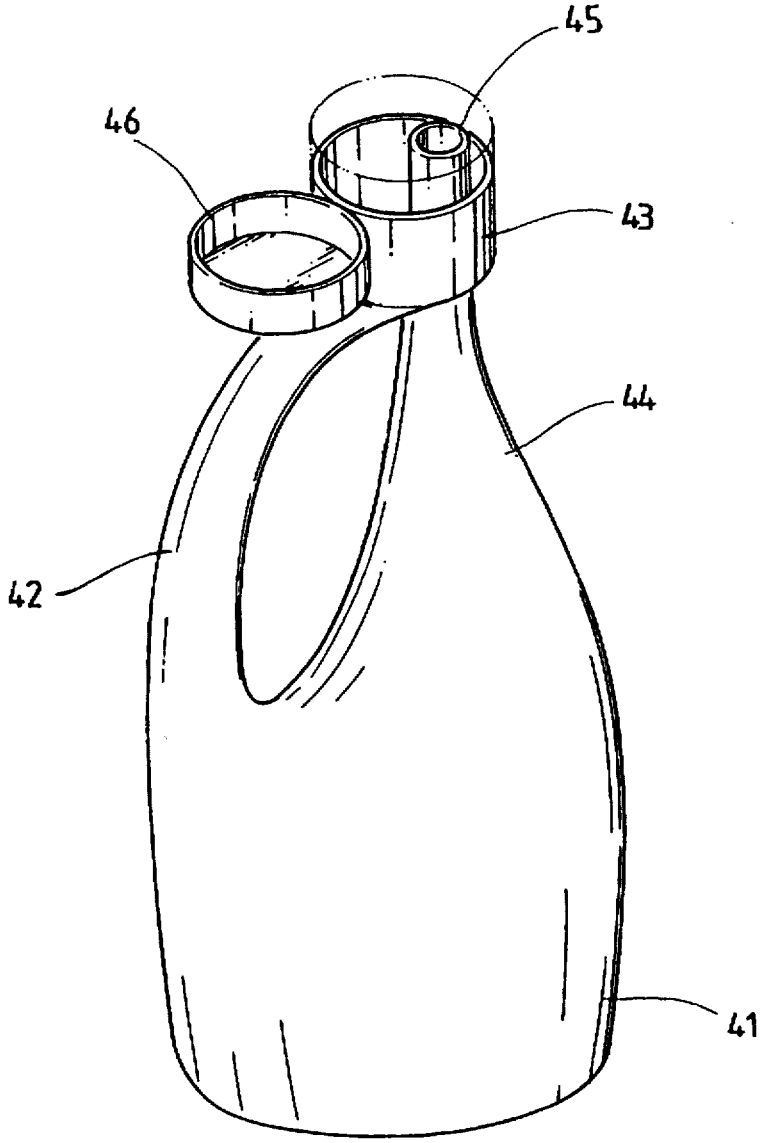
FIG. 5 is a perspective view of the vessel for containing liquid of FIG. 4.

According to a first embodiment of the invention, as shown in FIGS. 4 and 5, a vessel for containing liquid comprises a container 41 for containing liquid (40), a gripping portion 42 which is separated from one side of container 41 and extended upward, having an air intake portion 43 on the top of the gripping portion, wherein air flowing via air intake portion 43 passes through gripping portion 42 and communicates with container 41, and a neck portion 44 which is separated from the other side of container 41 and extended upward, having a liquid discharge portion 45 for discharging liquid from container 41 on the top of neck portion 44, wherein neck portion 44 passes through the bottom of the air intake portion 43 in gripping portion 42 and protrudes into air intake portion 43. Also, gripping portion 42 is designed to have a structure in which external air flowing through a space between air intake portion 43 and liquid discharge portion 45 can pass through gripping portion 42 to thereby enter container 41.

As shown in FIGS. 4 and 5, as an example of a means for preventing foreign matter from entering the vessel and to prevent spillage during the vessel's transport, a cap 46 having a hinge structure is provided so as to be capable of simultaneously covering air intake portion 43 and liquid discharge portion 45.

Figure 6:
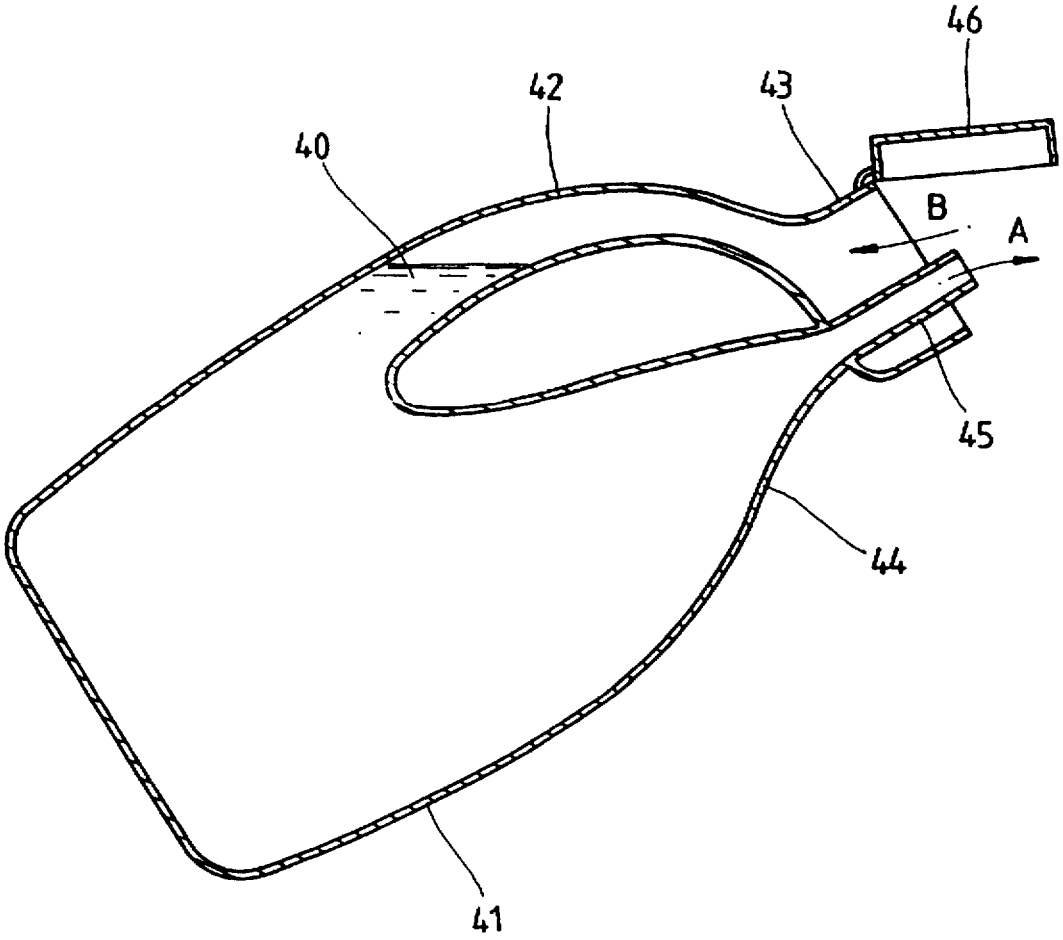
FIG. 6 shows a discharging state in the vessel for containing liquid of FIG. 4.

FIG. 6 shows a discharging state in connection with the vessel for containing liquid of the above-described first embodiment (FIG. 4).

Figure 1:
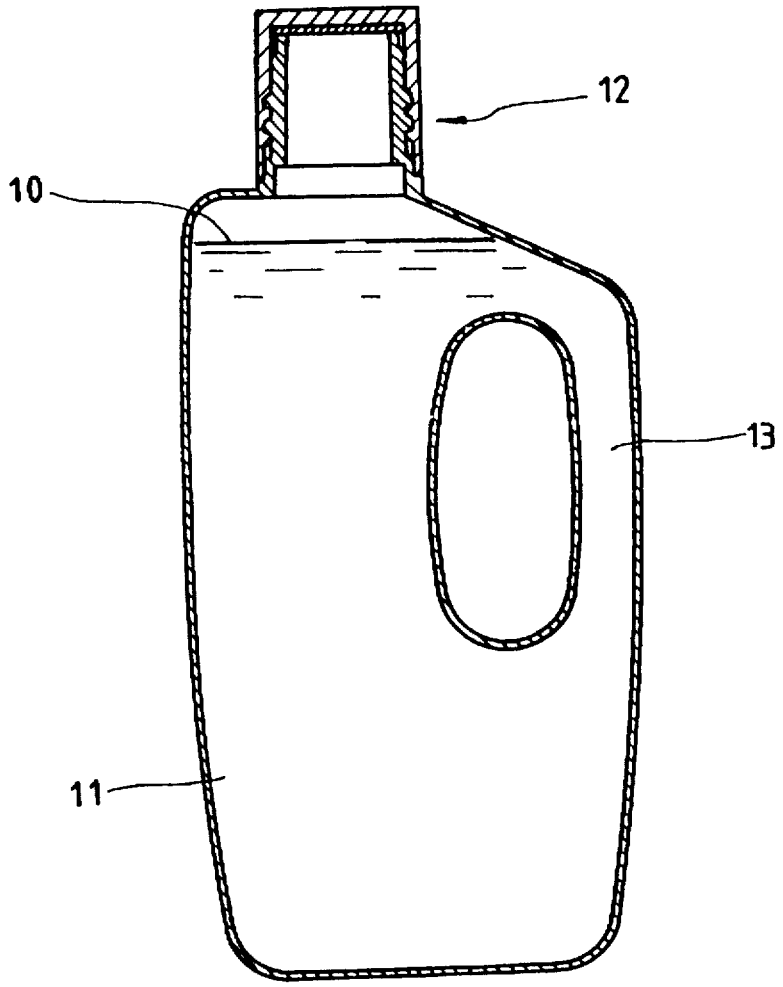
FIG. 1 PRIOR ART
FIG. 1 is a cross-sectional view of a conventional vessel for containing liquid.
Figure 2:
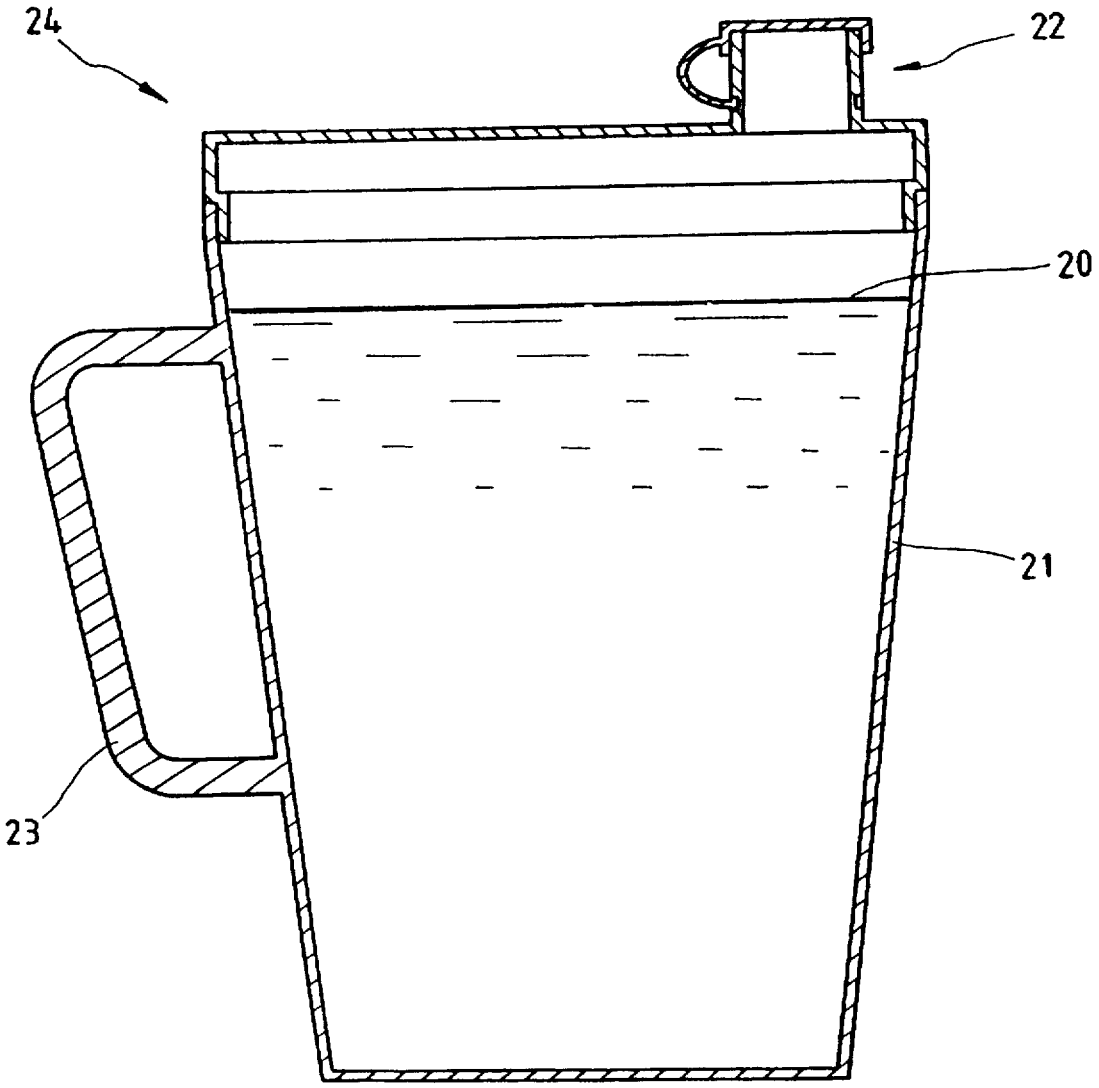
FIG.2 PRIOR ART
FIG. 2 is a cross-sectional view of another conventional vessel for containing liquid.
Figure 3:
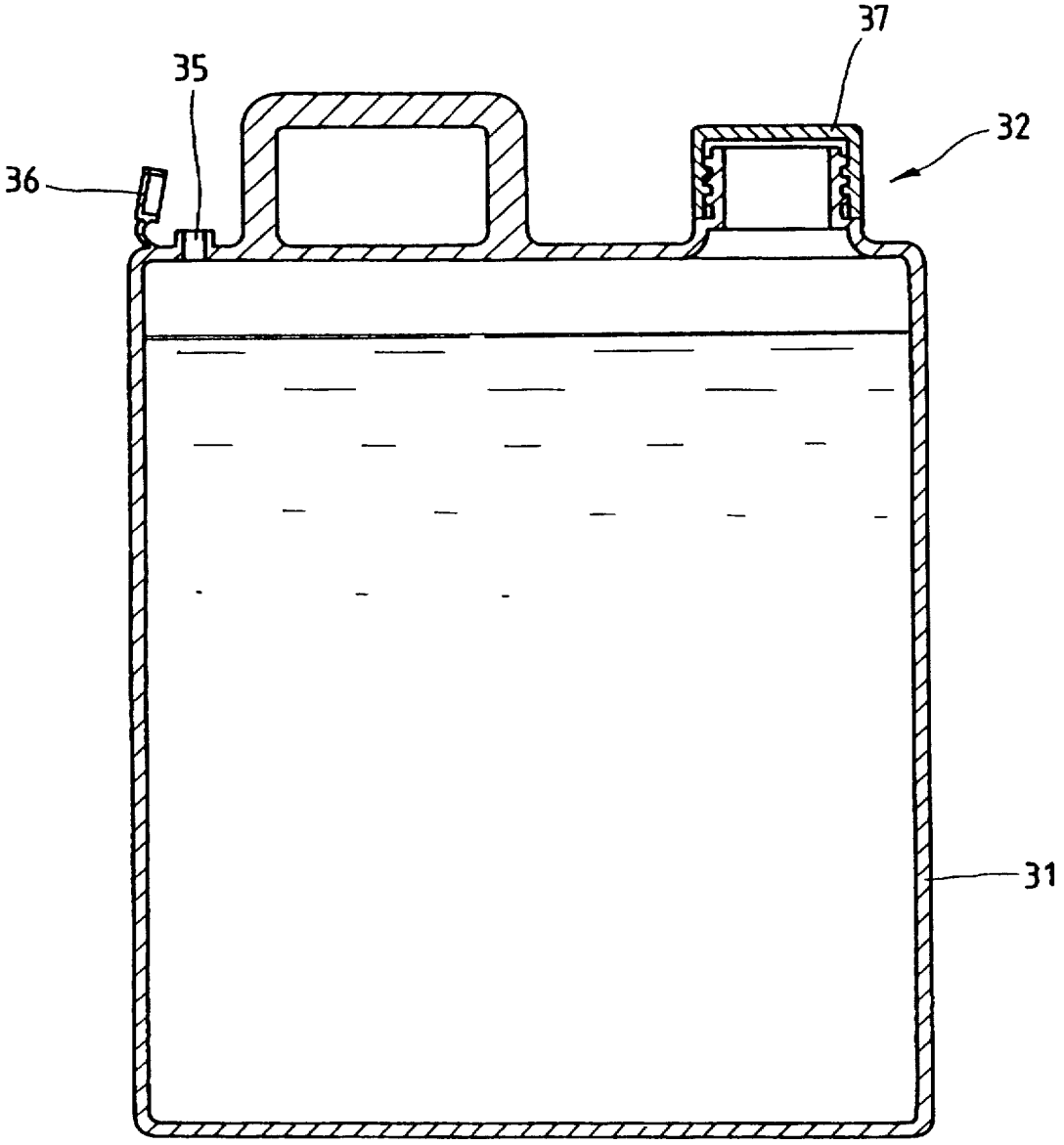
FIG.3 PRIOR ART
FIG. 3 is a cross-sectional view of still another conventional vessel for containing liquid having an air intake opening separated from a liquid discharge portion.

As shown in FIG. 6, if the vessel is tilted after opening cap 46 which is located on the upper end of the vessel, the liquid 40 in container 41 is discharged via liquid discharge portion 45, as indicated by arrow "A," and external air flows into the vessel via gripping portion 42 from air intake portion 43, as indicated by arrow "B. " Here, since the intake of the external air into the vessel is not interrupted by the liquid being discharged, the internal pressure of the vessel maintains the same level as the surrounding atmosphere. Accordingly, liquid can be smoothly poured from the vessel. Also, since liquid discharge portion 45 and air intake portion 43 are in the same position, when the liquid is to be discharged, the opening of a single cap (cap 46 only) is sufficient. Accordingly, contrary to the conventional vessel for containing liquid of FIG. 3, a separate air intake opening 35 and intake cap 36 are not needed.

Figure 7:
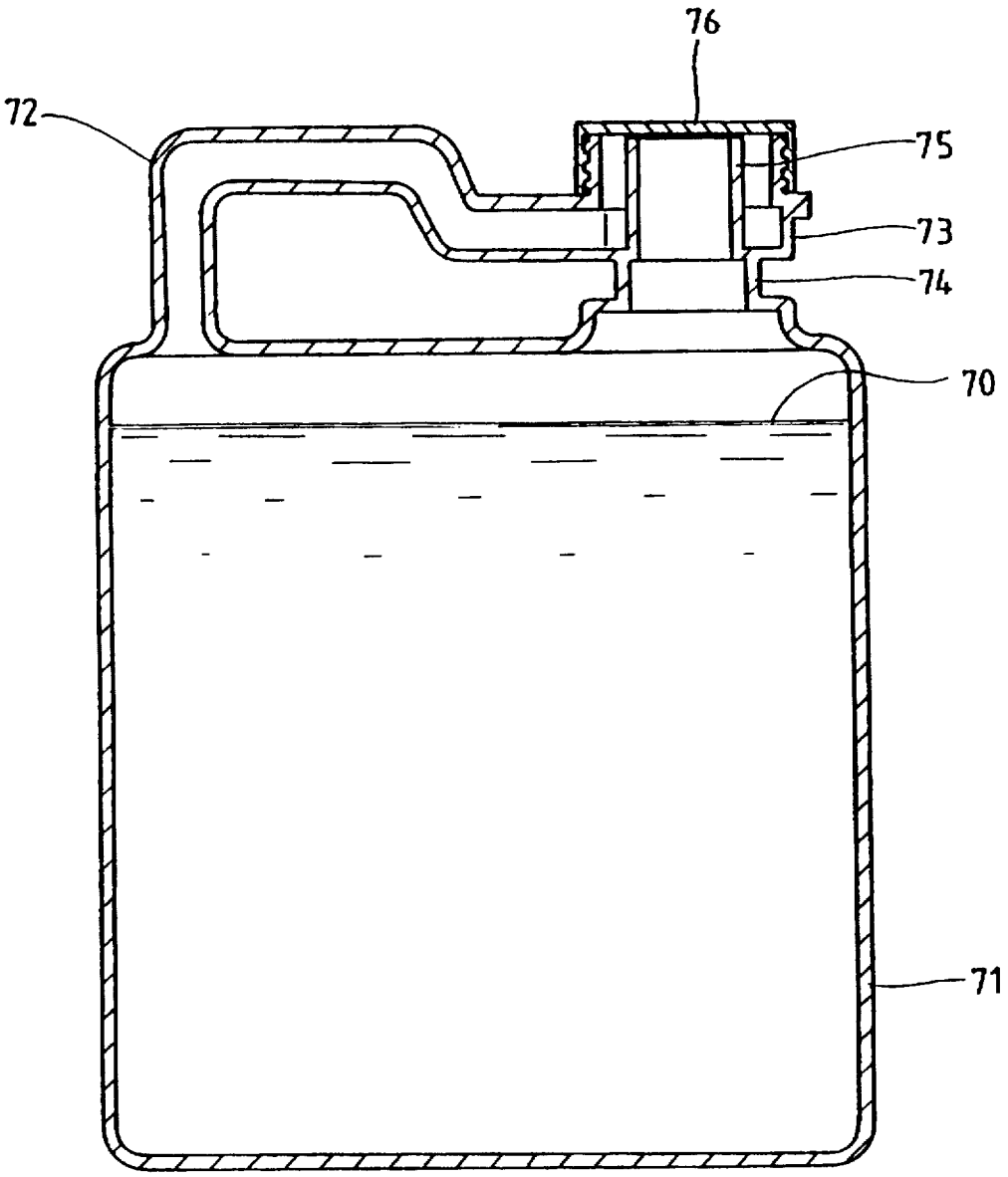
FIG. 7 is a cross-sectional view showing a vessel for containing liquid according to a second embodiment of the present invention.

FIG. 7 shows a second embodiment of the present invention. In FIG. 7, a gripping portion 72 is extended upward from the upper surface of one side of a container 71, and bent so as to be substantially parallel to the upper surface of container 71. A neck portion 74 is extended upward from the upper surface of the other side of container 71, and is shorter than that of neck portion 44 of the first embodiment (FIG. 4). Liquid discharge portion 75 for discharging liquid 70, which is located on the top of neck portion 74, passes through the lower surface of air intake portion 73 and protrudes outwardly. Here, cap 76 is provided so as to simultaneously cover air intake portion 73 and liquid discharge portion 75.

Figure 8:
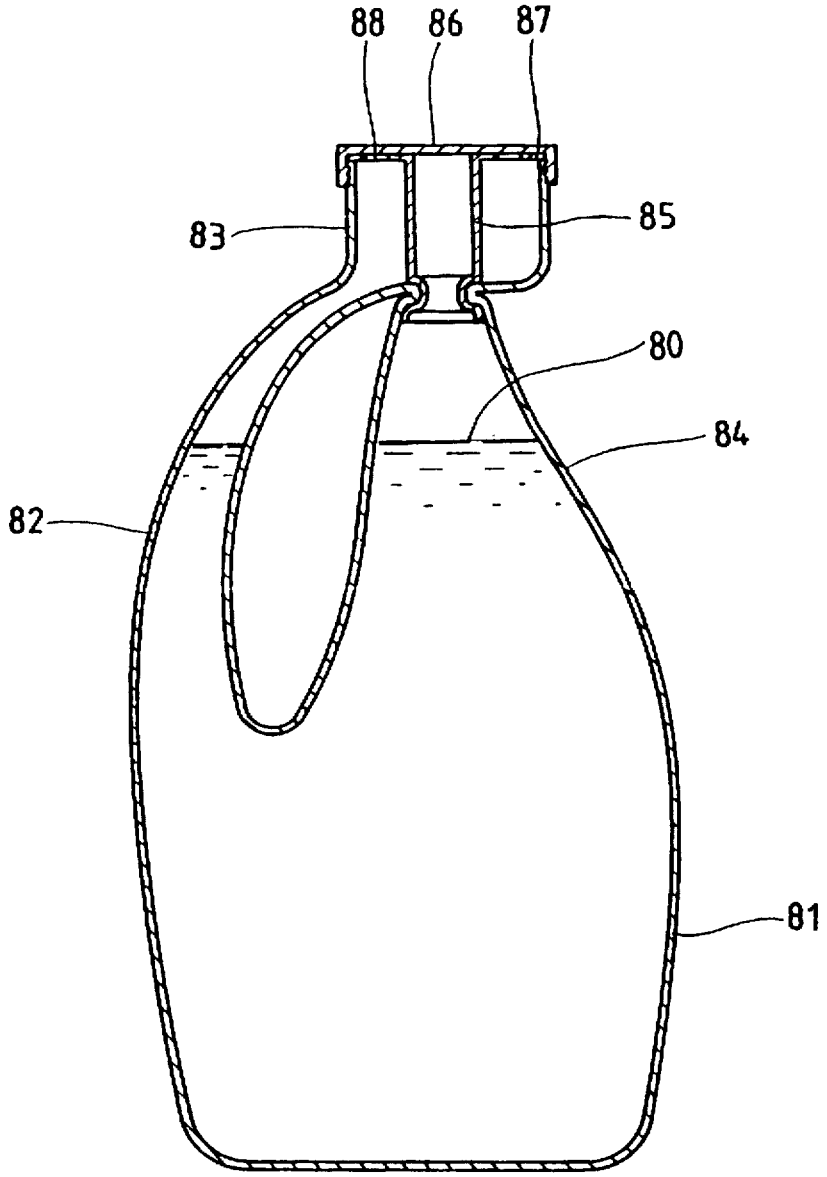
FIG. 8 is a cross-sectional view showing a vessel for containing liquid according to a third embodiment of the present invention.

FIG. 8 is a cross-sectional view showing a vessel for containing liquid according to a third embodiment of the present invention.

Figure 9:
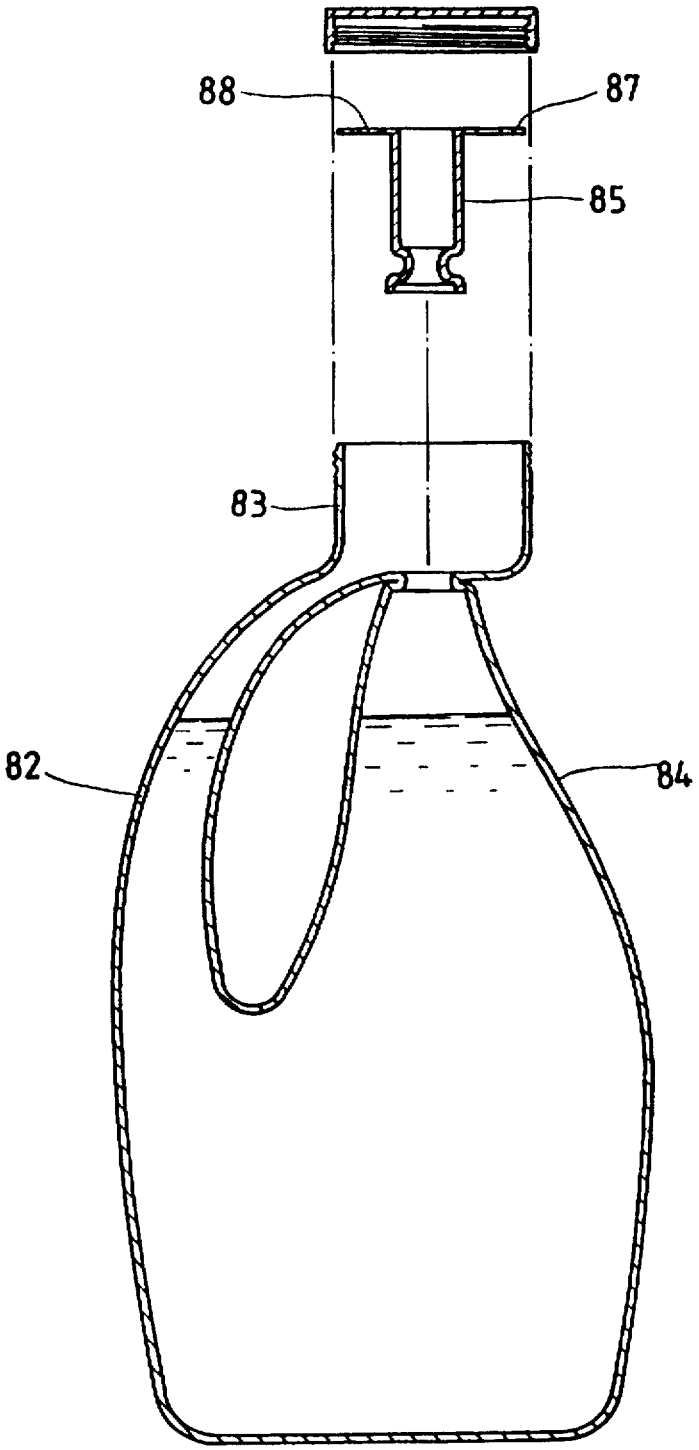
FIG. 9 is an exploded cross-sectional view of the vessel of FIG. 8.

FIG. 9 is an exploded cross-sectional view of the vessel of FIG. 8.

Differently from FIG. 4, the top portion of neck portion 84 communicates with the lower surface of air intake portion 83 which is located on the top portion of gripping portion 82. Here, a separate liquid discharge portion 85 is designed to be attachably and detachably fixed to the top portion of neck portion 84. Such a structure alleviates the considerable difficulties of the manufacturing of the first and second embodiments in which the neck portion and the liquid discharge portion are integrally formed and the liquid discharge portion passes through the bottom of the air intake portion, respectively.

Also, liquid discharge portion 85 for discharging liquid 80 of container 81 has a size corresponding to that of the top of air intake portion 83. Also, liquid discharge portion 85 has a flange 87 which is connected with the top portion of air intake portion 83, on the upper end of liquid discharge portion 85. In this case, flange 87 has at least one air intake opening 88 on its top surface, so that external air may enter the vessel.

In this embodiment, it is preferred that the lower portion of liquid discharge portion 85 is made of an elastic material such as rubber, so that liquid discharge portion 85 can be easily attached to and detached from neck portion 84. Here, cap 86 is provided so as to cover air intake portion 83 and/or flange 87.

Figure 10:
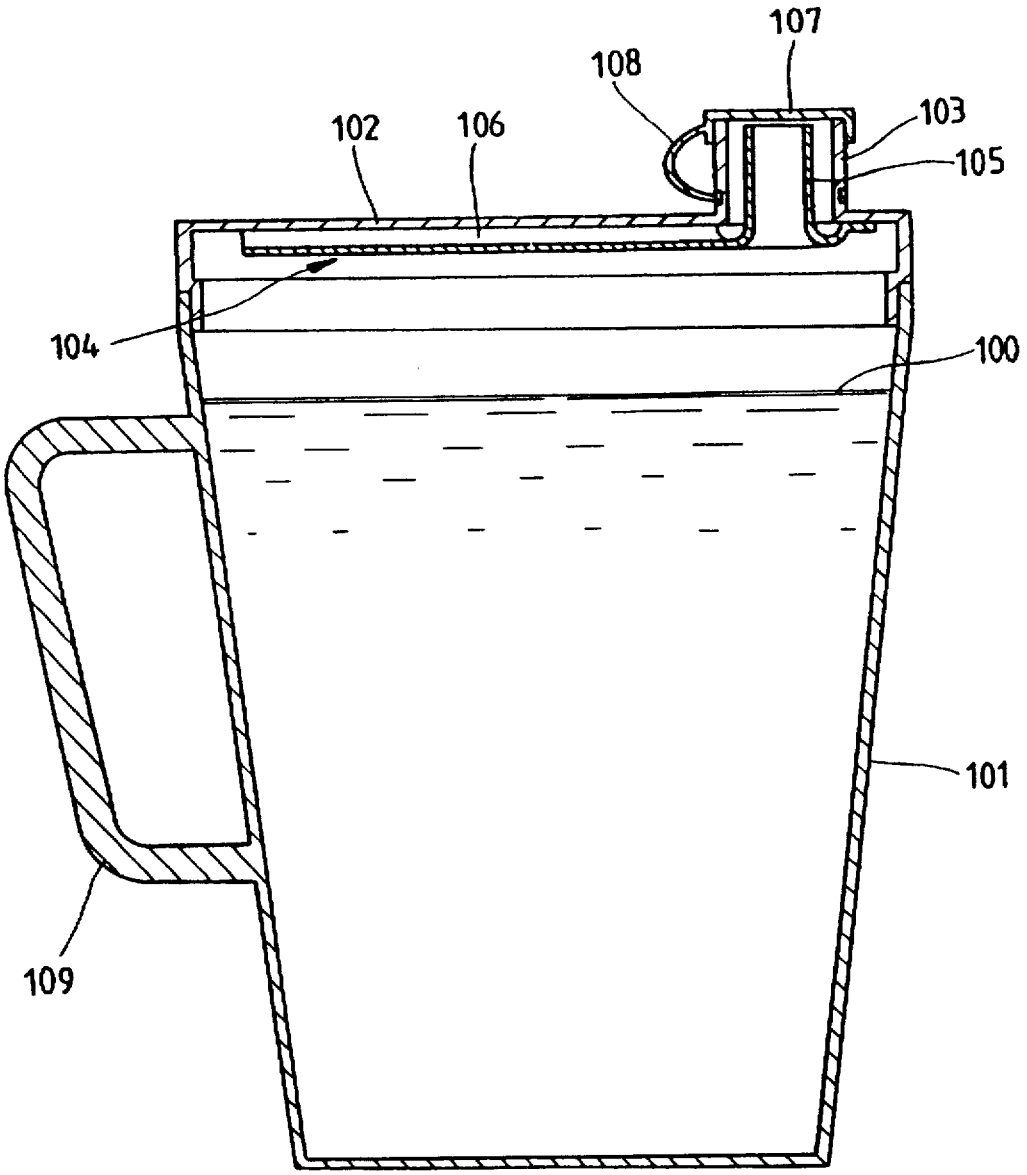
FIG. 10 is a cross-sectional view showing a vessel for containing liquid according to a fourth embodiment of the present invention.

FIG. 10 is a cross-sectional view showing a vessel for containing liquid according to a fourth embodiment of the present invention. In FIG. 10, cap 102 can be detached from container 101.

In the vessel for containing liquid shown in FIG. 10, differently from those of the first, second and third embodiments, the intake of external air into container 101 and the discharge of liquid from container 101 are accomplished through air intake passage 106' in intermediate member 104 provided in cap 102 and liquid discharge portion 105 which is provided on one side of intermediate member 104, respectively.

That is, cap 102 has air intake portion 103 on one side. Intermediate member 104 has at least one groove 106 which connects air intake portion 103 with the vessel inside the upper surface of intermediate member 104. Since the entire perimeter of intermediate member 104, except for groove 106, is secured to the lower surface of cap 102, the external air can enter the vessel via air intake passage 106' only. Also, intermediate member 104 is structured such that liquid discharge portion 105 is positioned at the point where air intake portion 103 in cap 102 is located, so that liquid can be poured from the vessel. Liquid discharge portion 105 passes through air intake portion 103 and protrudes outwardly. In FIG. 10, a reference numeral 107 denotes an end cap having a lanyard 108 and for covering air intake portion 103 formed in cap 102. Also a reference numeral 109 denotes a handle grip for maneuvering the vessel and which is formed on the side of container 101.

Figure 11:
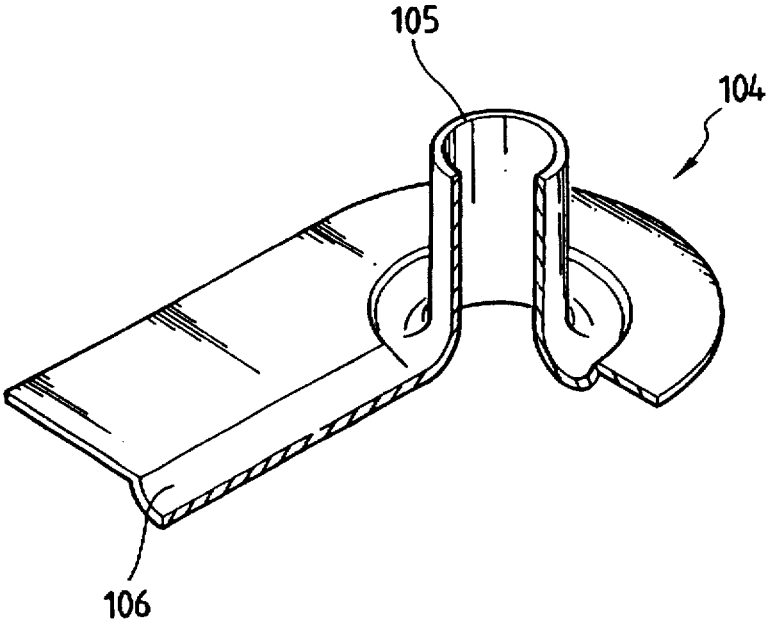
FIG. 11 is a partly exploded perspective view of an intermediate member in the vessel for containing liquid shown in FIG. 10.

FIG. 11 is a partly exploded perspective view of one example of an intermediate member in cap 102 shown in FIG. 10. As shown in FIG. 11, air intake passage 106' is formed such that its cross-section is crescent-shaped.

In the vessels for containing liquid of the second, third and fourth embodiments as described above, the state of discharging the liquid from inside the vessel to outside the vessel is absolutely the same as that described with respect to the first embodiment.

As described above, in the vessel for containing liquid according to the present invention, the liquid discharge portion and the air intake portion are provided jointly in a predetermined position so as to be covered with a single cap. Accordingly, without having a separate air intake opening and cap therefor, liquid can be smoothly poured from the vessel.

Industrial Applicability

The present invention can be applied to any vessel, such as a bottle, flask or jug of any size, made of any material, e.g., glass, plastic, metal etc., and for containing any liquid, such as water, oil or detergents in liquid form.

What is claimed is:

1. A vessel for containing liquid comprising:

an oval container having a flat bottom, a body, and a top portion for containing liquid, said body portion having a first and second portion defining a hollow therebetween;

said first portion having a hollow grip portion and said second portion having a hollow tapering neck portion;

said hollow grip portion separated from one side of the body of said container and extended upward through the top of said container and continuous with a circular hollow air intake portion continuous with the top of said grip portion and comprising a first part of the top of said container, wherein air flowing via said circular air intake portion passes through said hollow grip portion and communicates with said body portion of said container; and said hollow tapering neck portion continuous with the body portion of the container separated from the first portion of said container and extended upward continuous with an elongated cylindrical further tapered liquid discharge portion with a smaller section than that of said air intake portion for discharging liquid from said container located on the top of said neck portion forming a second part of the top of the container, wherein said liquid discharge portion additionally passes through and is completely contained within said air intake portion continuous with said grip portion providing for the opening of the liquid discharge portion located within the air intake portion so that air is taken into the container surrounding the area at which liquid is discharged from the container and so that the liquid can be smoothly discharged without generating an internal low pressure and a gurgling sound.

2. The vessel for containing liquid according to claim 1, wherein said liquid discharge portion is formed separately with respect to said neck portion so that the liquid discharge portion can be attachably and detachably fitted to the top portion of said neck portion and having a lower portion of said liquid discharge portion made of an elastic material.

3. The vessel for containing liquid according to claim 1, wherein said liquid discharge portion comprises a flange which is located on the top portion of said liquid discharge portion and connected with the top portion of said air intake portion, said flange comprising at least one air intake opening through which external air enters the vessel.

4. The vessel for containing liquid according to claim 1, further comprising a cap for simultaneously covering said air intake portion and said liquid discharge portion.

5. The vessel for containing liquid according to claim 2, further comprising a cap for simultaneously covering said air intake portion and said liquid discharge portion.

6. The vessel for containing liquid according to claim 3, further comprising a cap for simultaneously covering said air intake portion and said liquid discharge portion.

7. A vessel for containing liquid comprising:

a container for containing liquid, whose upper portion is open;

a cap which is designed to cover the open upper portion of said container, having an air intake portion to one side of said cap; and an intermediate member having an upper surface, a lower surface, and a hollow liquid discharge portion with a smaller section than that of said air intake portion extending upward from said upper and lower surfaces, said intermediate member being formed with at least one groove on said upper surface, wherein said upper surface is fixed onto the lower surface of said cap so that said liquid discharge portion passes through said air intake portion and protrudes outside said container at the point where said air intake portion of said cap is located, and that at least one air intake passage is formed between said lower surface of said cap and said groove of said intermediate member of guiding air flowing via said air intake portion of said cap into said container; and an end cap for covering the air intake portion, said end cap having a lanyard.

* * * * *